US005570072A

United States Patent [19]

King

[11] Patent Number: 5,570,072

[45] Date of Patent: Oct. 29, 1996

[54] METHOD OF ESTABLISHING A RELAY CONTACT ARRANGEMENT

[75] Inventor: George King, Pompano Beach, Fla.

[73] Assignee: Siemens Stromberg-Carlson, Boca Raton, Fla.

[21] Appl. No.: 367,657

[22] Filed: Jan. 3, 1995

[51] Int. Cl.[6] ..... H01H 1/66

[52] U.S. Cl. ..... 335/154; 335/151

[58] Field of Search ..... 335/151, 152, 335/153, 154

[56] References Cited

U.S. PATENT DOCUMENTS

| | | | |
|---|---|---|---|
| 3,579,158 | 5/1971 | Kutyla | 353/151 |
| 3,974,468 | 8/1976 | Ygfors | 335/151 |
| 4,084,142 | 4/1978 | Campbell et al. | 335/152 |
| 4,182,999 | 1/1980 | Walsh | 335/154 |
| 4,191,935 | 3/1980 | Archer et al. | 335/154 |
| 4,752,754 | 6/1988 | Strauss | 335/151 |

FOREIGN PATENT DOCUMENTS

| | | | |
|---|---|---|---|
| 48911 | 5/1988 | European Pat. Off. | 335/151 |
| 636505 | 9/1960 | Italy | 335/151 |

*Primary Examiner*—Lincoln Donovan
*Attorney, Agent, or Firm*—Joseph S. Codispoti

[57] ABSTRACT

A method of establishing a contact arrangement for a reed switch. The method increases the number of contact surfaces between the armature and the fixed contact by providing the fixed contact with a contact end that has multiple prongs and positions the armature and the fixed contact so that the prongs surround the armature. The method also adjusts the armature and the fixed contact so that there are prongs that contact the armature when the armature moves from the rest position during switch operation and prongs that provide additional multi-planar contact surfaces for the armature in the event that the armature and the fixed contact prematurely separate during switch operation.

10 Claims, 4 Drawing Sheets

METHOD OF ESTABLISHING A RELAY CONTACT ARRANGEMENT

TECHNICAL FIELD

A related application entitled "AN IMPROVED REED RELAY" by the same inventor is being filed on the same day herewith and is incorporated by reference herein.

The invention relates to a method of establishing a contact arrangement for a reed relay that reduces contact separation during relay operation.

BACKGROUND OF THE INVENTION

Reed relays are well-known electrical devices that are generally used in applications where fast operating times, reliability, and sensitivity are required. Typical applications include data processing, communications and computer equipment, logic circuitry and other types of sophisticated control circuits.

FIG. 1 illustrates one type of a typical existing reed relay called a dry reed relay 1. The dry reed relay 1 uses dry reed switches 10 consisting of long, thin contact blades 12, 14 hermetically sealed in a glass capsule 16 with terminations 18, 20 extending from respective ends of the capsule 16*a*, 16*b*. The reed switches 10 are sealed inside the glass capsule 16 in an atmosphere of dry inert gas. The encapsulation seals out contaminates and extends the useful life of the contact blades 12, 14. The relay 1 also has an operating coil 22 that is wound on a bobbin 24 that has cavities 24*a* within which a number of the glass capsules 16 are inserted. This creates a coil-switch assembly. The terminations 18, 20 of the reed switches 10 are connected to terminal pins 26, 28 which extend from the assembly, for example, as printed circuit board terminals. The entire assembly is contained within an enclosure 30 with the terminal pins 26, 28 extending from the enclosure 30.

Another type of reed relay is a mercury-wetted contact reed relay. This type of reed relay has a glass capsule that contains fixed contacts, a long thin movable armature blade located between the fixed contacts, and a small reservoir of mercury. The capsule is hermetically sealed, for example, in a high pressure hydrogen atmosphere. The use of mercury insures continual renewal of contact material, constant contact characteristics and permanent low contact resistance. The mercury also provides for an absence of contact bounce and makes for positive contact closure. The relay also has an operating coil that is wound on a bobbin that has cavities within which a number of the glass capsules are inserted. The terminations of the fixed contacts and the armature are connected to terminal pins which extend from the assembly. The entire assembly is contained within an enclosure with the terminal pins extending from the enclosure.

A limitation of the existing dry reed relay is the risk of contact separation during contact switching (i.e., contact bounce or chatter) and during vibrations and other disturbances of the relay operation. This has an impact on reliability and sensitivity and, thus, degrades relay performance. The only alternative is the use of more expensive and more complicated mercury-wetted contact reed relays. In certain applications, however, mercury-wetted contact reed relays may not be suitable. Consequently, a dry reed relay with a reduced contact separation characteristic is desirable.

SUMMARY OF THE INVENTION

Briefly, the invention provides a method of establishing a contact arrangement for a reed switch that reduces the separation of the contact ends of the fixed contact and the armature contact during switch operation. The method comprises the steps of providing a respective contact with a contact end that has multiple prongs; positioning the contacts so that the prongs of the respective contact surround the contact end of the other contact, said prongs being formed to surround the contact end in a predetermined geometric arrangement; adjusting the armature contact to be in a rest position; and adjusting the contacts so that certain of the prongs make contact with the contact end of the other contact when the armature contact moves from the rest position during switch operation and certain of the prongs provide multi-planar contact surfaces for the contact end of the other contact in the event that the armature contact and the fixed contact prematurely separate during switch operation.

The step of adjusting the contacts may include adjusting the contacts so that, in the event that a respective prong and the contact end of the other contact prematurely separate during switch operation, at least one of the prongs providing multi-planar contact surfaces maintains the connection between the armature contact and the fixed contact. In addition, the step of adjusting the contacts may include adjusting the contacts so that, in the event that a respective prong and the contact end of the other contact prematurely separate during switch operation, the contact end of the other contact contacts at least one of the prongs providing multi-planar contact surfaces before re-establishing contact with the respective prong.

Each of the prongs may include a contact pad that forms a contact surface that ensures level contacting with the contact end of the other contact. Also, the contact end of the other contact may be formed to have contact surfaces that complement the surrounding geometric arrangement of the prongs.

Advantageously, the invention provides a contact arrangement that anticipates the separation movements of the reed contacts. Consequently, the reed contacts are less vulnerable to separation during, for example, vibration. Further, the reed contact switching has reduced contact bounce or chatter.

The invention also contributes to higher reliability, greater sensitivity and longer life since more than one contact surface, or a larger contact surface, is established between the reed contacts.

DETAILED DESCRIPTION

Figure 1:
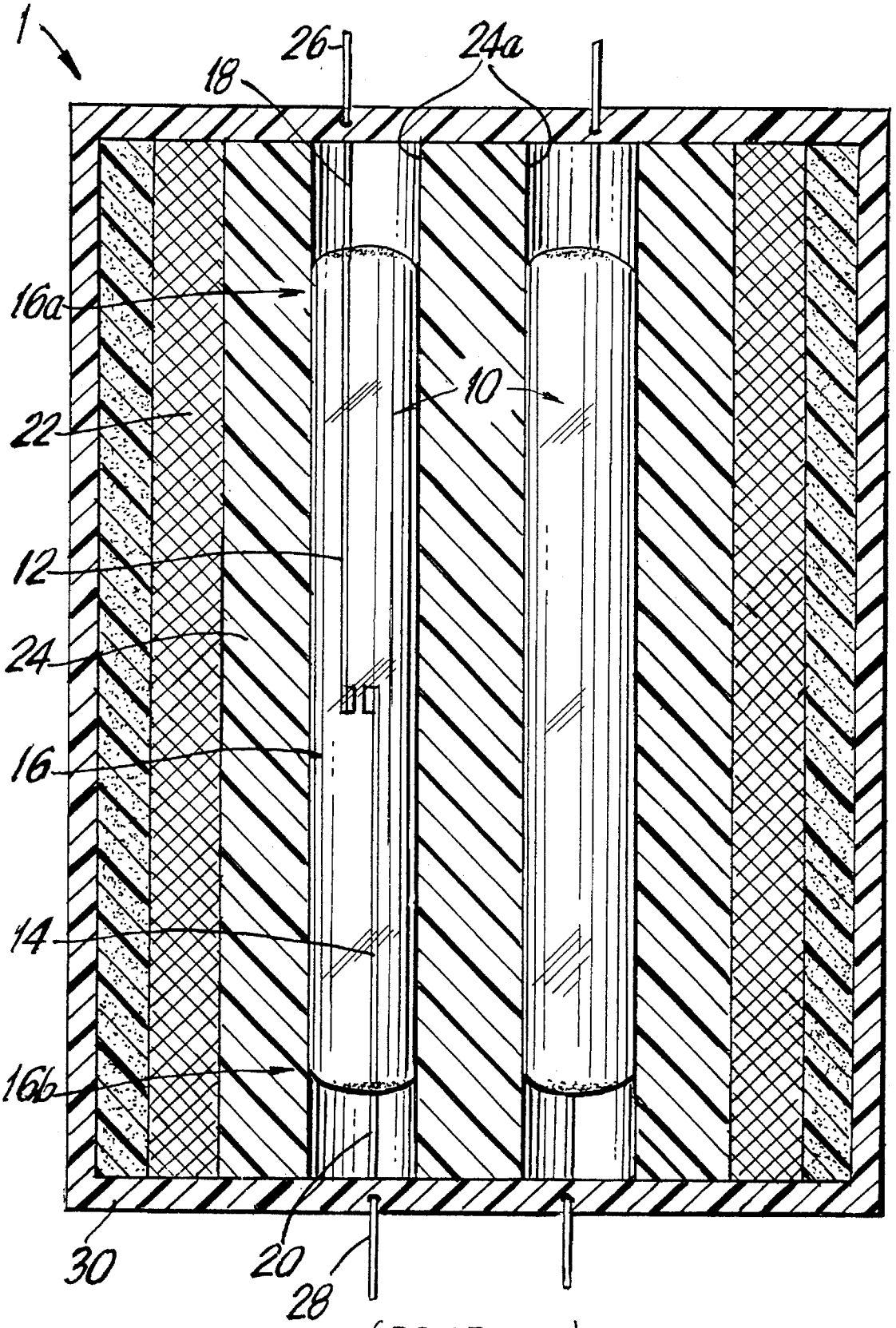
(PRIOR ART) FIG. 1
FIG. 1 is a lengthwise sectional view of a typical existing reed contact relay.
Figure 2:
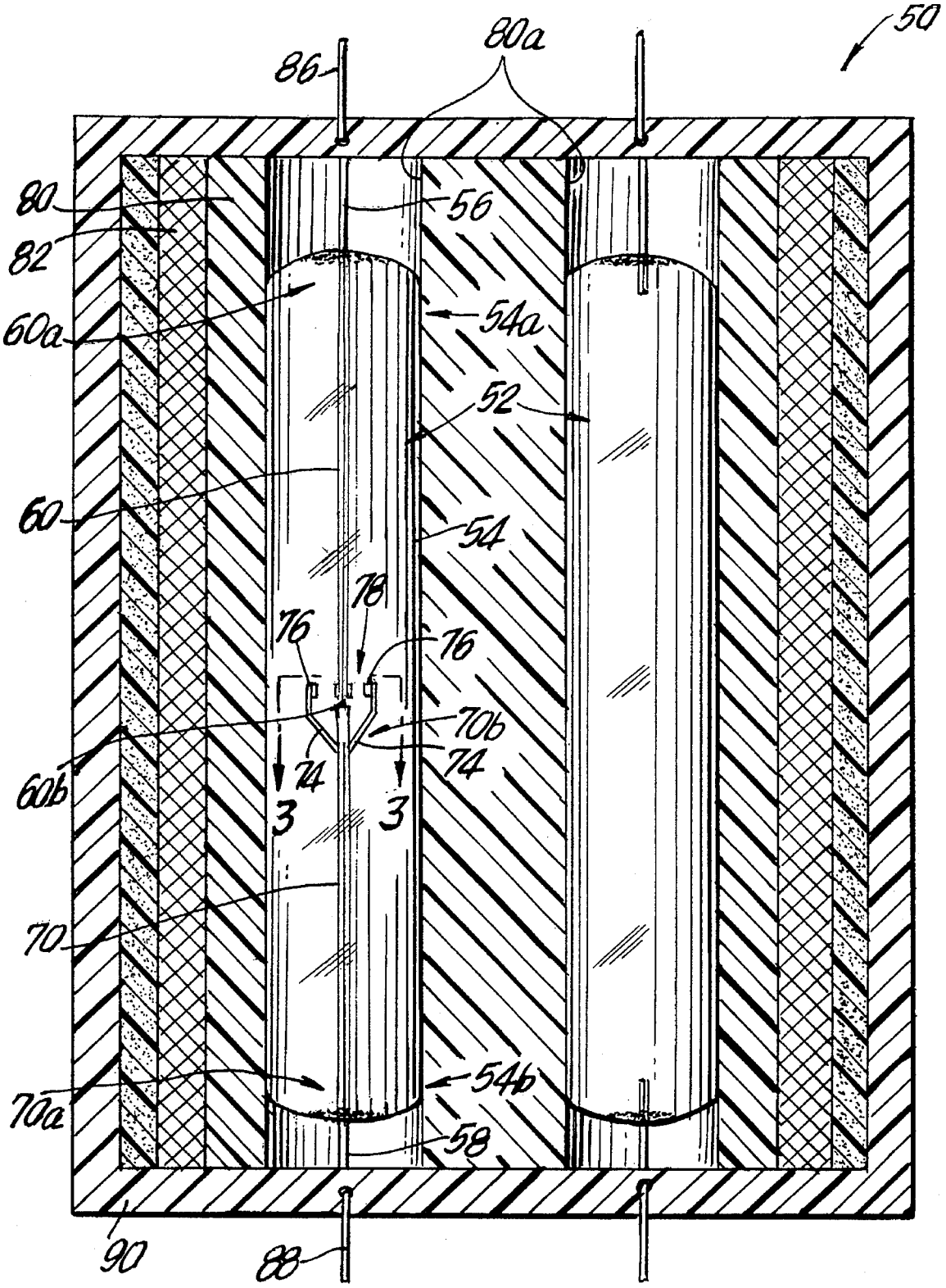
FIG. 2 is a lengthwise sectional view of a reed contact relay constructed in accordance with the present invention.

FIG. 2 shows a lengthwise sectional view of a reed relay 50 constructed in accordance with the present invention. The relay 50 has at least one dry reed switch 52. The reed relay switch 52 consists of an elongate sealed housing 54 that is formed of glass or other insulating material. Typically, the housing 54 is cylindrical in shape although other configurations are useable. A first elongate terminal 56 extends from a first end 54*a* of the housing 54 and a second elongate terminal 58 extends from the other end 54*b* of the housing 54. Each of the terminals 56, 58 also projects a certain distance into the housing 54. The housing 54 and the terminals 56, 58 may be joined in any conventional manner that hermetically seals the housing 54 and traps, for example, a dry inert gas atmosphere therein. The terminals 56, 58 may be made from any conventional relay terminal material that is both magnetic and electrically-conductive, such as, iron-nickel.

The housing 54 also contains a first elongate contact blade 60 that is joined at one end 60*a* to the end of the first terminal 56 which projects into the housing 54. The other end 60*b* of the first contact blade 60 projects freely into the housing 54. The free end 60*b* of the first contact blade 60 forms a relay contact surface and may be plated with any conventional contact metal, such as, diffused gold. The contact blade 60 serves as the armature for the relay 50.

The housing 54 also contains a second elongate contact blade 70 that is joined at one end 70*a* to the end of the second terminal 58 which projects into the housing 54. The other end 70*b* of the second contact blade 70 projects freely into the housing 54 toward the free end 60*b* of the first contact blade 60. The second contact blade 70 serves as the fixed contact for the relay 50. The free end 70*b* of the second contact blade 70 is forked with multiple branches or prongs 74. Each prong 74 has a contact pad 76 that forms a relay contact surface and that may be plated with any conventional contact metal, such as, diffused gold. The contact blades 60, 70 may be made from any conventional relay contact material that is both magnetic and electrically-conductive, such as, iron-nickel.

Figure 3A:
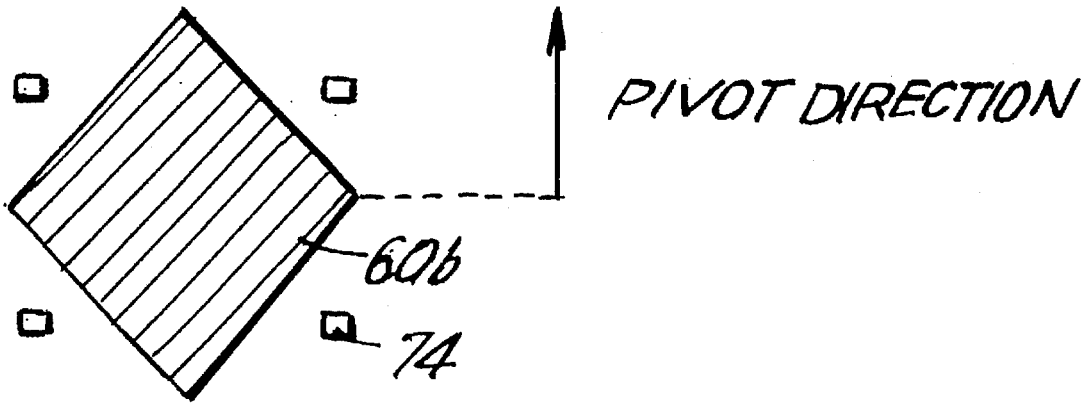
FIG. 3*a* is a view of the relay of FIG. 2 along sectional lines 3—3.
Figure 3B:
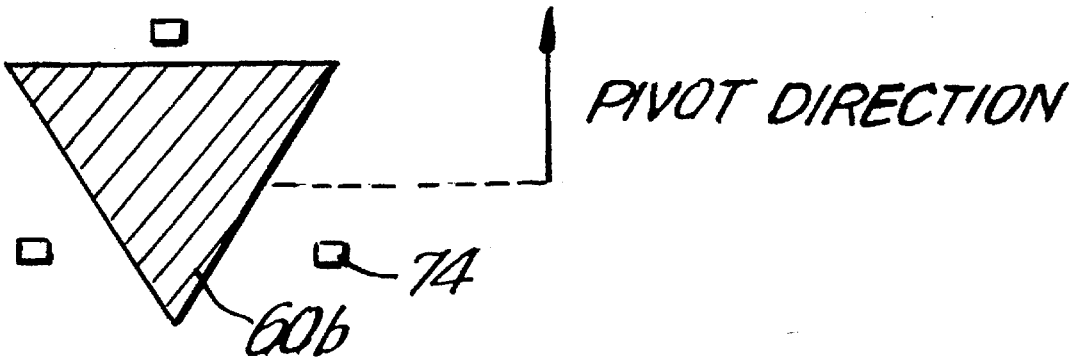
FIG. 3*b* is an alternate view of the relay of FIG. 2 along sectional lines 3—3.

The two contact blades 60, 70 project within the housing 54 such that the prongs 74 of the second contact blade 70 surround the free end 60*b* of the first contact blade 60. Each of the pads 76 is situated to contact a different surface area of the free end 60*b* of the first contact blade 60 and a respective working gap 78 is formed therebetween. In addition, each pad 76 is formed to ensure level contacting with the respective surface area of the free end 60*b* of the first contact blade 60. The prongs 74 may be formed to surround the free end 60*b* of the first contact blade 60 in any desired geometric arrangement, e.g., triangular, rectangular, etc., and the free end 60*b* of the first contact blade 60 may be formed to have contact surfaces that complement the desired geometric arrangement of the prongs 74. FIG. 3*a* is a sectional view of the relay 50 that shows the prongs 74 in a rectangular arrangement around the free end 60*b* of the first contact blade 60 formed with a rectangular cross-sectional area. FIG. 3*b* is an alternate sectional view of the relay 50 that shows the prongs 74 in a triangular arrangement around the free end 60*b* of the first contact blade 60 formed with a triangular cross-sectional area.

The reed switch 52 is contained in a cavity 80*a* of a bobbin 80. An operating coil 82 is wound around the bobbin 80. This creates a coil-switch assembly for the relay 50. The bobbin 54 and operating coil 82 may be constructed and configured in any conventional manner. The terminals 56, 58 of the reed switch 52 are joined to terminal pins 86, 88 which extend outward from the assembly. The relay assembly is normally covered with potting compound and securely contained within a hard insulated casing 90. The terminal pins 86, 88 extend outward from the casing 90.

In operation, the first contact blade 60, which serves as the armature, is adjusted in a conventional manner to be in a neutral position so that the free end 60*b* is surrounded by and does not contact the prongs 74 of the second contact blade 70. In this way, the first contact blade 60, which is cantilevered, acts as a spring without initial pressure. When the operating coil 82 is energized by external circuitry, a magnetic field is generated that creates a magnetic force which tends to pivot the first contact blade 60. In pivoting, the first contact blade 60 moves away from its neutral rest position and contacts the contact pads 76 of certain of the multiple prongs 74. The arrows in FIGS. 3*a* and 3*b* show the pivot direction from the neutral rest position for the first contact blade 60. The particular arrangement of the prongs 74 determines which pads 76 are in the pivot path and are to be contacted. For the described relay 50, which is in a normally-open mode, the making of contact between the two contact blades 60, 70 closes the circuit that includes the relay 50.

The armature contact blade 60 may separate from one or more of the fixed contact pads 76 during contact switching (i.e., contact bounce or chatter) and during vibrations or other disturbances of the relay operation. In the event of lateral movement (relative to the pivot path) and twisting or other multi-dimensional movement (relative to the pivot path) by the armature contact blade 60, the additional number of fixed contact pads 76 and their specific positioning around the free end 60*b* of the armature contact blade 60 maintains the armature contact blade 60 in contact with at least one of the other fixed contact pads 76. In the event of simple one-dimensional movement back along the pivot path by the armature contact blade 60, the additional number of fixed contact pads 76 and their specific positioning around the free end 60*b* of the armature contact blade 60 can shorten the duration of contact separation since the traveling distance of the armature contact blade 60 to contact at least one of the other fixed contact pads 76 may be shortened. Each particular arrangement of the prongs 74 obtains a different level of contact certainty, i.e., different number of fixed contact pads 76 that can maintain contact with the armature contact blade 60.

The invention thus reduces contact separation by enlarging the contact surface or increasing the number of contact surfaces between the armature contact blade 60 and the fixed contact blade 70. The invention also reduces contact separation by establishing a multi-planar contact arrangement that anticipates the separation movements of the armature contact blade 60 and that also shortens the distances between various contact surfaces.

The embodiments described herein are merely illustrative of the principles of the present invention. Various modifications may be made thereto by persons ordinarily skilled in the art, without departing from the scope or spirit of the invention. For example, the first contact blade 60 may serve as the fixed contact for the relay 50 and the second contact blade 70 may serve as the armature for the relay 50.

Figure 4:
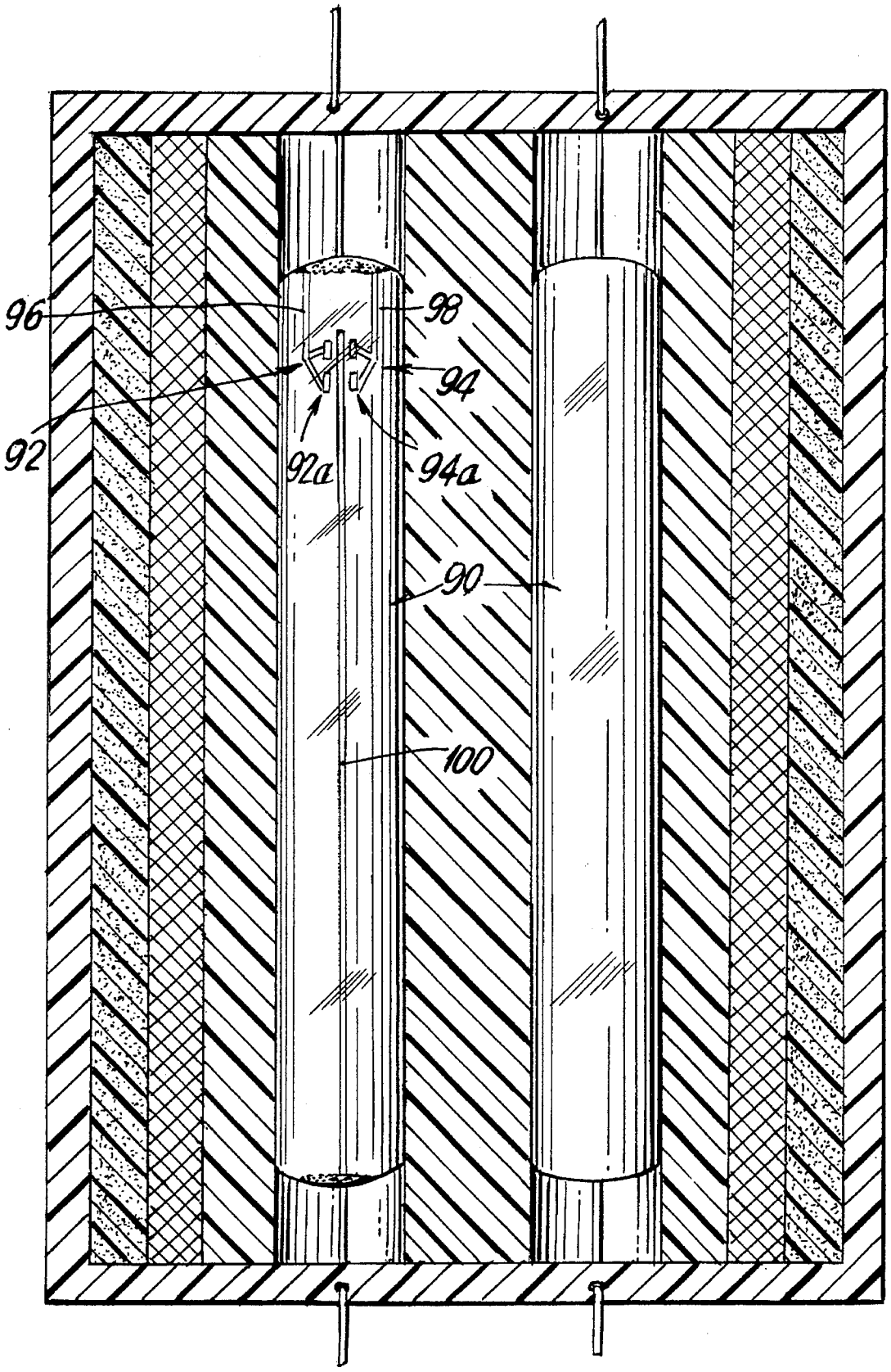
FIG. 4 is a lengthwise sectional view of another embodiment of a reed contact relay constructed in accordance with the present invention.

Also, the contacts of the reed switch 52 may be in a normally-closed mode rather than in a normally-open mode. Also, the contacts may be in single pole, double throw form, rather than in single pole, single throw form. As shown in FIG. 4, this may be accomplished by having the two fixed contacts 92, 94 that are joined to respective pole pieces 96, 98 in such a switch 90 formed with associated prongs 92*a*, 94*a* extending therefrom with the armature 100 positioned between the two fixed contacts 92, 94. This can also be accomplished, for example, by splitting the fixed contact blade 70 into two sections, each section and associated prongs 74 representing a respective "throw". For such a switch, each set of prongs (for each "throw") surrounds only a portion of the free end of the armature contact blade.

Further, each of the prongs 74 may be of different lengths and cross-sectional areas if required by the configuration or movement of the armature contact blade 60. Further, the fixed contact blade 70 may have a free end 70*b* that has an enlarged contact surface but does not have multiple contact surfaces (for example, a hollow end with an opening and cavity that receives the free end 60*b* of the first contact blade 60). Further, the reed relay 50 may operate using external magnets for the actual armature operation or for merely armature adjustment.

What is claimed is:

1. A method of establishing a contact arrangement for a reed switch that reduces the separation of the contact ends of the fixed contact and the armature contact during switch operation, comprising the steps of:

a. providing a respective contact with a contact end that has multiple prongs;

b. positioning the contacts so that the prongs of the respective contact surround the contact end of the other contact, said prongs being formed to surround the contact end in a predetermined geometric arrangement;

c. adjusting the armature contact to be in a rest position; and d. adjusting the contacts so that certain of the prongs make contact with the contact end of the other contact when the armature contact moves from the rest position during switch operation and certain of the prongs provide multi-planar contact surfaces for the contact end of the other contact in the event that the armature contact and the fixed contact prematurely separate during switch operation.

2. The method of claim 1, wherein the step of adjusting the contacts comprises adjusting the contacts so that, in the event that a respective prong and the contact end of the other contact prematurely separate during switch operation, at least one of the prongs providing multi-planar contact surfaces maintains the connection between the armature contact and the fixed contact.

3. The method of claim 1, wherein the step of adjusting the contacts comprises adjusting the contacts so that, in the event that a respective prong and the contact end of the other contact prematurely separate during switch operation, the contact end of the other contact contacts at least one of the prongs providing multi-planar contact surfaces before re-establishing contact with the respective prong.

4. The method of claim 1, wherein each of the prongs has a contact pad that forms a contact surface that ensures level contacting with the contact end of the other contact.

5. The method of claim 1, wherein the contact end of the other contact is formed to have contact surfaces that complement the surrounding geometric arrangement of the prongs.

6. A method of establishing a contact arrangement for a reed switch, comprising the steps of:

a. providing a fixed contact with a contact end that has multiple prongs;

b. positioning an armature and the fixed contact so that the prongs of the fixed contact surround the contact end of the armature, said prongs being formed to surround the armature in a certain geometric arrangement; and c. adjusting the armature and the fixed contact so that certain prongs contact the contact end of the armature when the armature moves from the rest position during switch operation and certain prongs provide multi-planar contact surfaces for the contact end of the armature in the event that the armature and the fixed contact prematurely separate during switch operation.

7. The method of claim 6, wherein the step of adjusting comprises adjusting the armature and the fixed contact so that, in the event that a respective prong and the contact end of the armature prematurely separate during switch operation, the armature contacts at least one of the prongs providing multi-planar contact surfaces to maintain the connection between the armature and the fixed contact.

8. The method of claim 6, wherein the step of adjusting comprises adjusting the armature and the fixed contact so that, in the event that a respective prong and the contact end of the armature prematurely separate during switch operation, the armature contacts at least one of the prongs providing multi-planar contact surfaces before re-establishing contact with the respective prong.

9. The method of claim 6, wherein each of the prongs has a contact pad that forms a contact surface that ensures level contacting with the contact end of the armature.

10. The method of claim 6, wherein the contact end of the armature is formed to have contact surfaces that complement the surrounding geometric arrangement of the prongs.

* * * * *